US010317164B2

(12) United States Patent
Ady

(10) Patent No.: US 10,317,164 B2
(45) Date of Patent: Jun. 11, 2019

(54) CATAPULT BOWSTRING WEIGHT

(71) Applicant: Daniel Ady, Caldwell, ID (US)

(72) Inventor: Daniel Ady, Caldwell, ID (US)

( * ) Notice: Subject to any disclaimer, the term of this patent is extended or adjusted under 35 U.S.C. 154(b) by 0 days.

(21) Appl. No.: 15/884,629

(22) Filed: Jan. 31, 2018

(65) Prior Publication Data

US 2018/0216908 A1 Aug. 2, 2018

Related U.S. Application Data

(60) Provisional application No. 62/452,901, filed on Jan. 31, 2017.

(51) Int. Cl.
*F41B 5/10* (2006.01)
*F41B 5/14* (2006.01)

(52) U.S. Cl.
CPC ..... *F41B 5/1411* (2013.01); *F41B 5/10* (2013.01)

(58) Field of Classification Search
CPC .. F41B 5/00; F41B 5/10; F41B 5/1407; F41B 5/1411; F41B 5/1415
See application file for complete search history.

(56) References Cited

U.S. PATENT DOCUMENTS 2,617,402 A * 11/1952 Roemer ..... F41B 5/14 124/23.1
2,956,560 A * 10/1960 Stockfleth ..... F41B 5/14 124/90
3,059,629 A * 10/1962 Stinson ..... F41B 5/00 124/23.1
5,016,604 A * 5/1991 Tilby ..... F41B 5/1426 124/92
8,656,900 B1 * 2/2014 Kronengold ..... F41B 5/123 124/86

* cited by examiner

*Primary Examiner* — John Ricci
(74) *Attorney, Agent, or Firm* — Scott D. Swanson; Shaver & Swanson, LLP

(57) ABSTRACT

What is disclosed is a slideable weight for use on an archery bow. The slideable weight is configured to travel from a position near a limb of an archery bow or a pulley of a compound archery bow toward a midline of the bowstring. This creates a catapult like effect that increases the speed of an arrow released from the bow. The device can conceivably be used on any archery bow, including compound, recurve, or other bow.

20 Claims, 12 Drawing Sheets

CATAPULT BOWSTRING WEIGHT

PRIORITY/CROSS REFERENCE TO RELATED APPLICATIONS

This application claims the benefit of U.S. Provisional Application No. 62/452,901 filed Jan. 31, 2017, the disclosure of which is incorporated by reference.

FIELD OF THE INVENTION

This invention relates generally to a weight that is placed on a bowstring near one or more ends of the bowstring. Currently weights that are placed on the bowstring are stationary and typically spaced at a measured distance between each other. Generally the weights have different shapes, sizes and weight depending on their desired affect. Bow companies will add different grains of weight, spaced approximately ½" apart from each other for purposes of creating a whiplash or catapult effect. The purpose of adding weight to the bowstring is to increase arrow speed of an arrow shot from the bow.

BACKGROUND OF THE INVENTION

A compound archery bow typically includes a pair of pulleys, with at least one of the pulleys having a cam surface to provide a mechanical advantage while drawing the bow. Recently weights have been added to the bowstring to enhance arrow speed, which is extremely imperative for most archers. Bowstring weights have a range of 3 to 20 grains, and are usually spaced at different distances to enhance arrow speed. When the bowstring is pulled back and released, the weight closer to the cam travels at a lower speed than does the weight closer to the center of the string. A common distance between the weights is ½ to 1 plus inches. Several variables are figured in to determine the number of weights; the amount of grains of the weight; the distance between the weights; and number of cams on the compound bow. Greater arrow speed lessens arrow trajectory. An arrow is shot through a chronograph to measure arrow speed. A weight displacement chart is given to customers showing how to place the weight(s) on the bow; the space between the weights; and the grains recommended by the bow manufacturer. After the bowstring is released by the archer, the bowstring travels toward the riser of the bow. The two or more distantly spaced weights attached to the bowstring move forward toward the riser, but travel at a different momentum, allowing the weight closest to the center of the bowstring to have greater velocity and forward momentum than the upper weight closest to the cam. In effect the weight closer to center causes a catapult reaction on the bowstring, effectively enhancing arrow speed.

SUMMARY OF THE INVENTION

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

The embodiments described in this disclosure enable an archer to effectively place a single weight within or outside of a bowstring and perform the same function as multiple weights on a bowstring. A slideable weight (any item with mass), attached within or on the outside of a bowstring, will follow the path of least resistance due to the inertia of the bowstring being released from full draw. Currently a bowstring will have several weights spaced apart that cause a catapult effect, wherein will enhance arrow speed. Most compound bows have two plus weights on the bowstring that are spaced apart; the top weight (closest to the cam) travels less distance than the lower weight (closer to the middle of the string). Weight closer to the middle of the string affects arrow speed negatively. If not for the catapult effect, the lower weight will impede arrow speed.

This invention allows the lower weight to be connected toward the top of the cam while the bowstring is pulled back and released. Usually the higher the poundage, the faster the arrow. It is a fact that other criteria affect arrow speed as well. As the center of the bowstring comes closer toward handle, the inertia of the weight will separate the magnet (or any mass) from the ferrous metal post, and be forced down until being biased back by spring or magnetic repulsion, and will rest again at the position nearest the cam(s). It might be appreciated that the weight may be any material that has mass or shape. Examples may be neodymium iron boron magnet, metal, plastic, or sphere shaped. The weight may bias upward closer to the cam by using a long spring that may suspend the weight closest to the cam during the static period. It may be understood that the mass weight that accelerates by inertia due to the bowstring being released, may be any mass such as a magnet, iron, plastic, or any substance that travels within or around the outside of the bowstring or cable. The weight may also travel between the bowstring, or around the bowstring; and the distance the weight travels will be determined by a diminishing return factor.

Embodiments of the invention may be external to the bowstring, with the mass weight traveling up and down and around the outer circumference of the bowstring. Embodiments of the invention may have an embodiment placed between a parted string. The internal embodiment may have a cylinder shape which holds the mass weight within the chamber; however, the cylinder shape may be sphere or any geometric design. This holds true with the inner weight within the cylinder shape, being any shape such as a cylinder, sphere, disk, or any other geometric design. The purpose of having one weight traveling a determined distance is for increased arrow speed. With this invention the one weight will lock or be held at the top of the stroke, until the bowstring is released by the archer. At this time the bowstring will move forward toward the handle on the bow riser, forcing (by inertia) the weight toward the center of the bowstring.

The weight being closer to the cam(s) through a large portion of the stroke is paramount for arrow speed. Not carrying the weight closer inward, or nearer to the center of the bowstring increases arrow speed. Having the slideable weight (between or outside of the bowstring) to increase arrow speed, is a needed invention for the archery community. A need to bias the weight back the resting point is done by spring, foam, or magnetic repulsion. The weight will rest at the home position (nearest the cam) until inertia forces it toward the center of the string. Once the mass weight has ended the stroke, it will be forced back home by a biasing mechanism such as a spring or repulsion of a magnet. An "Internal" or "External" Catapult system functions similarly, except all functions with the "Internal" system happens between the bowstring, while the "External" system works outside or around the bowstring.

BRIEF DESCRIPTION OF THE DRAWINGS

The summary above and the following detailed description will be better understood in view of the enclosed drawings which depict details of preferred embodiments. It should however be noted that the invention is not limited to the precise arrangement shown in the drawings, and that the drawings are provided merely as examples.

FIG. 17 also depicts one magnet above the ferromagnetic material, and one magnet below the ferromagnetic material.

DETAILED DESCRIPTION

Figure 1:
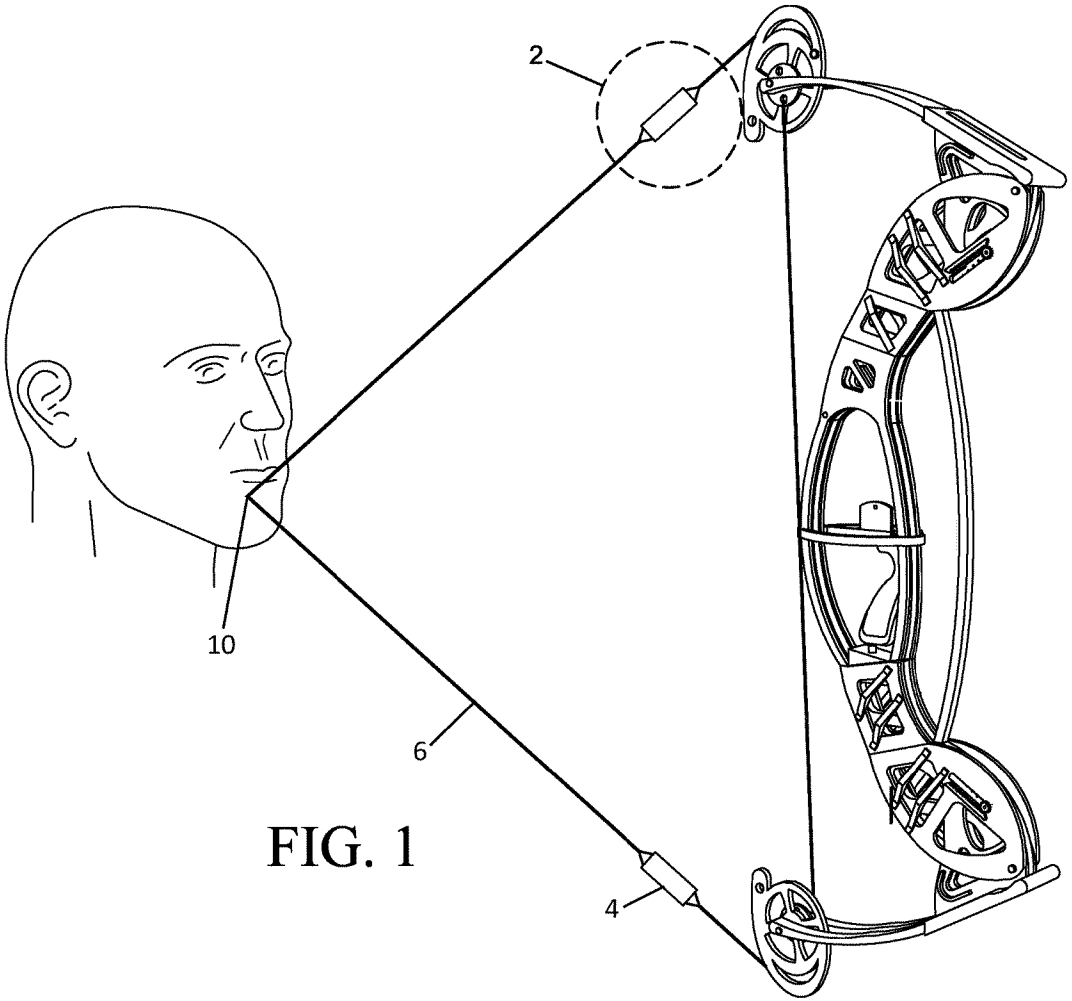
FIG. 1 is a side view perspective showing an embodiment of the invention in an archery environment.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 is a side perspective view showing an embodiment of the invention in an archery environment. As shown are two "Internal Catapult" apparatuses 2, 4, which include a slideable weight (shown in subsequent drawings), positioned on a bowstring 6 to increase arrow speed. The weight on the string is located closest to the cam as to not slow the arrow down. The more weight placed near the center or midline of the bowstring 10, the more adverse reaction on arrow speed. FIG. 1 shows the bowstring at full draw. The weight located within the housing of the Internal Catapult is closest to the cam in the home position or proximal end.

Figure 2:
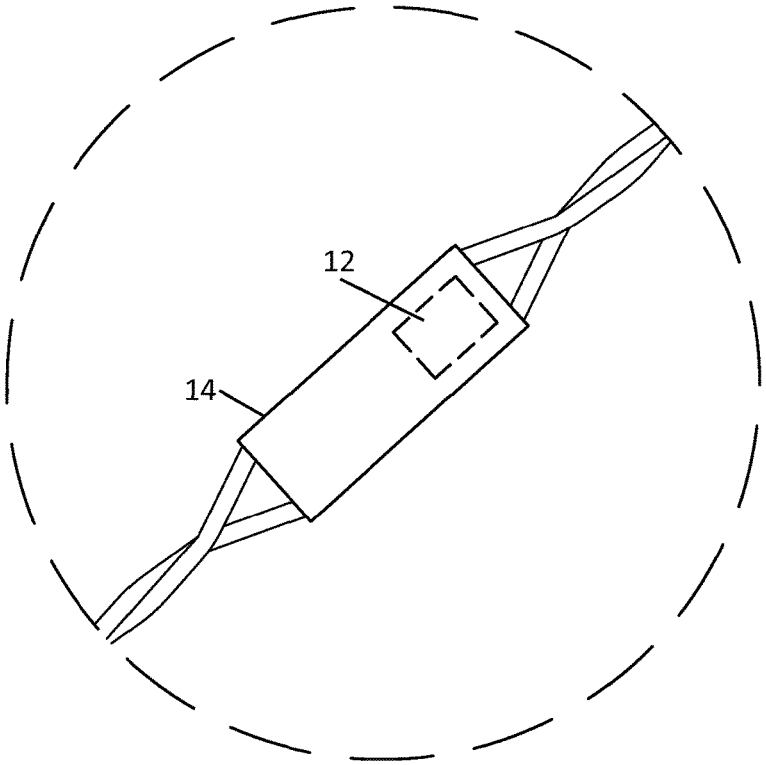
FIG. 2 is a detail view taken from FIG. 1 of the embodiment of the invention, a slideable weight attached to a bowstring.
Figure 3:
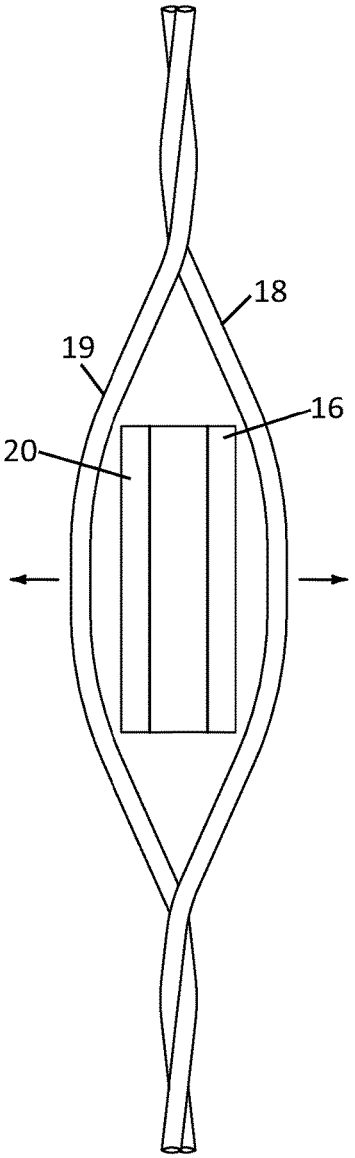
FIG. 3 shows a twisted bowstring split apart generally to equal portions preparatory to laying each portion into a groove of the depicted embodiment. The embodiment is an internal catapult, slideable weight system.
Figure 4:
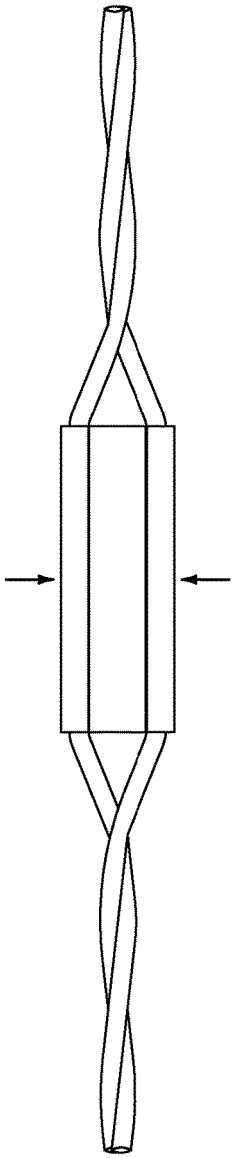
FIG. 4 is a front view showing the portions of the split bowstring laid into respective grooves of the internal catapult, slideable weight system.

FIG. 2 is a detail view taken from FIG. 1 of the embodiment of the invention; a slideable weight 12 is shown within a housing 14 that is attached to a bowstring. Bowstrings are typically constructed of multiple strands woven together. The weight is in the home or first position prior to the bowstring being pulled or drawn, during the beginning of the pull, and holding back the bowstring prior to releasing the bowstring. As depicted in FIGS. 3 and 4, strands 18, 19 of a bowstring follow bowstring grooves 16, 20 on either side of the "Internal Catapult". The "Internal Catapult" housing is placed between the parted bowstring. The weight is configured to slide up and down within the housing. It may be noted that the weight may be cylinder, round, square, hexagon, or any geometric configuration. It may also be noted that the housing may be a cylindrical shape, a spherical shape or any other geometric configuration.

FIG. 3 depicts a twisted bowstring split apart generally to equal portions preparatory to laying each portion into a groove of the depicted embodiment. The embodiment is an "Internal Catapult" system with a G-force regulated slideable weight within.

FIG. 4 is a front view showing the portions of the split bowstring laid into respective grooves of an embodiment of the "Internal Catapult", slideable weight system. The twisted bowstring will depart (usually equal strands) and locate within the Internal Catapult housing.

Figure 5:
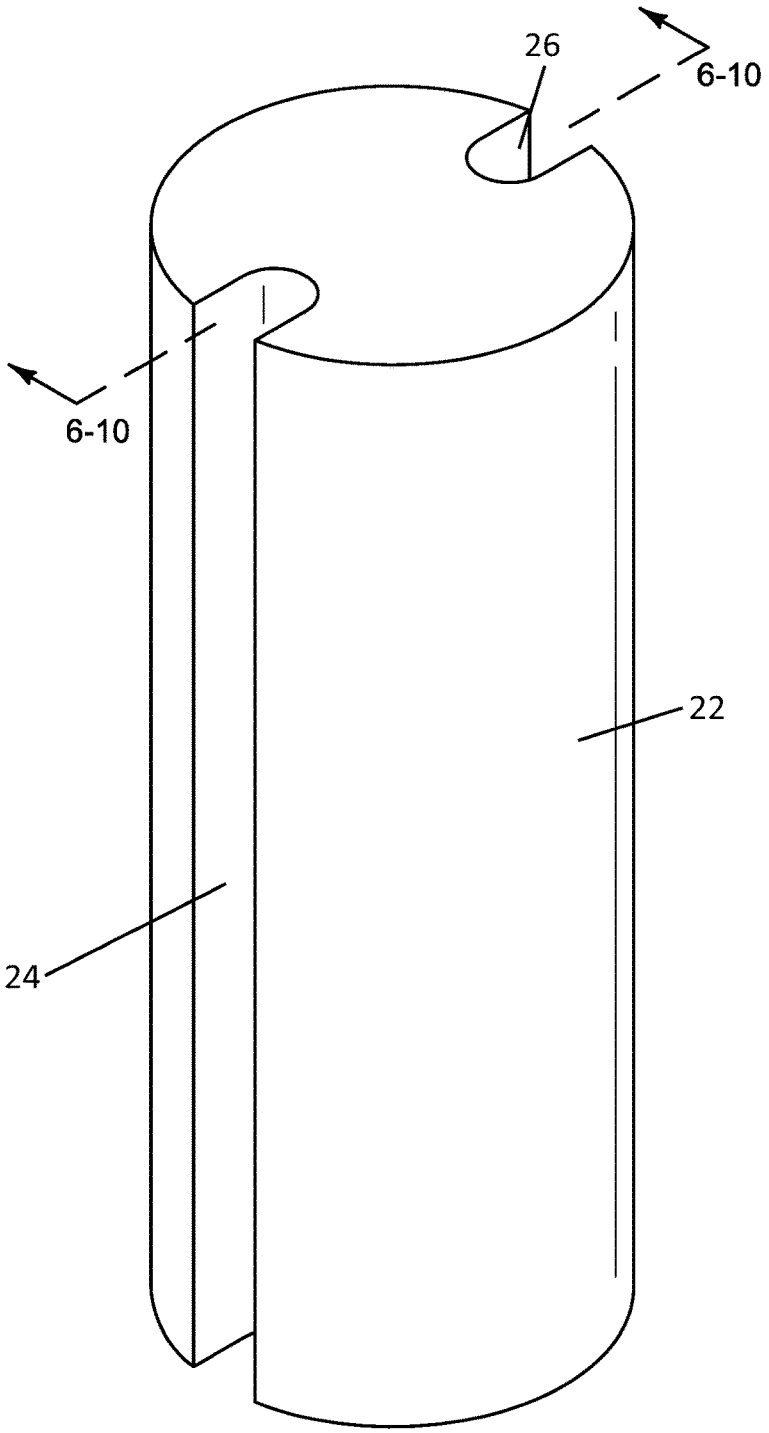
FIG. 5 is a view of the internal catapult system. The grooves 6-10 are to accommodate a parted bow string.

FIG. 5 is a view of an embodiment of the Internal Catapult system in which a cylindrical housing is shown. Grooves 24, 26 shown in dissectional views of FIGS. 6-10 along line 6-10, are to accommodate a parted bow string. The grooves located on the Internal Catapult will help keep it secure on the bowstring.

Figure 6:
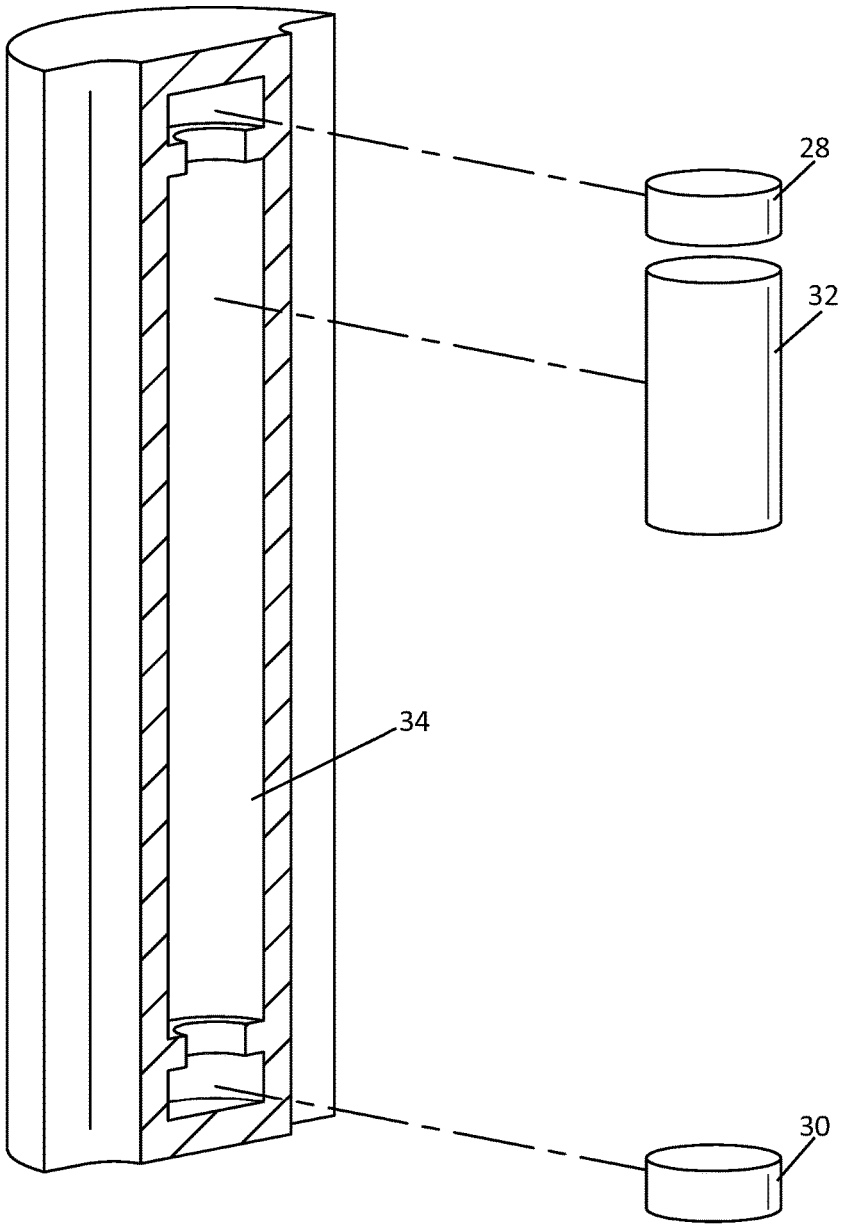
FIG. 6 is a sectioned view of internal components of an embodiment of an "Internal Catapult". Also depicted are two magnets and a weight.

FIG. 6 is a sectioned view of the internal components of an embodiment of the "Internal Catapult". The depicted embodiment utilizes two smaller magnets 28, 30 and a slideable weight 32. The proximal small magnet (or ferrous material) may fit in a slot located within the proximal end of the "Internal Catapult" housing. Its function is to be attracted to the weight and suspend the weight in the home or first position. The heavier slideable weight may be a magnet, or any ferrous material with mass. The G-force required to separate the smaller magnet to the larger weight or magnet may be regulated with strength of the magnet, or by distance between the two magnets. It may be noted the smaller disc may be a magnet or any ferrous material. The heavier mass or slideable weight may also be magnet or any ferrous material. A retaining mechanism, in the depicted embodiment magnet 28 in conjunction with magnet or weight functions to keep the slideable weight at the first position but allows it to separate from the first position when G-force is applied as generated by the bow being shot. The bottom magnetic disc 30 is placed in a slot for the purpose of biasing the weight back to the home position after the bowstring becomes static. The lower small disc magnet will have a repulsive force; hence, sending the heavier slideable weight upward through chamber 34 until locking to a material at the proximal end of the housing, which is the end of the housing closest to the pulley, cam or limb of the bow.

Figure 7:
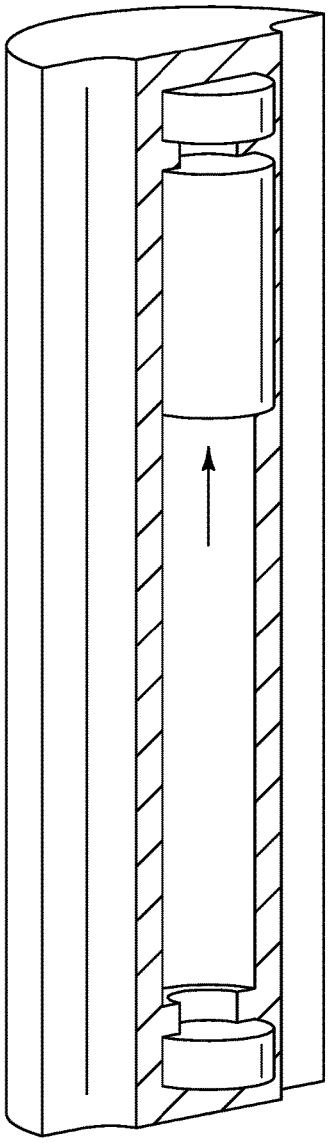
FIG. 7 is a view showing the weight in the home position of an embodiment of an "Internal Catapult".

FIG. 7 is a view showing the slideable weight in the home or first position of the "Internal Catapult". The home position of the heavier slideable weight is in a static position, waiting for the inertia of the bowstring being released to escape the G-force or external force strong enough to dislodge the connection between both materials. Again, the proximal smaller disc may be magnetic or ferrous material; and the heavier slideable weight may also be magnet or ferrous material, as long as they attract to each other.

Figure 8:
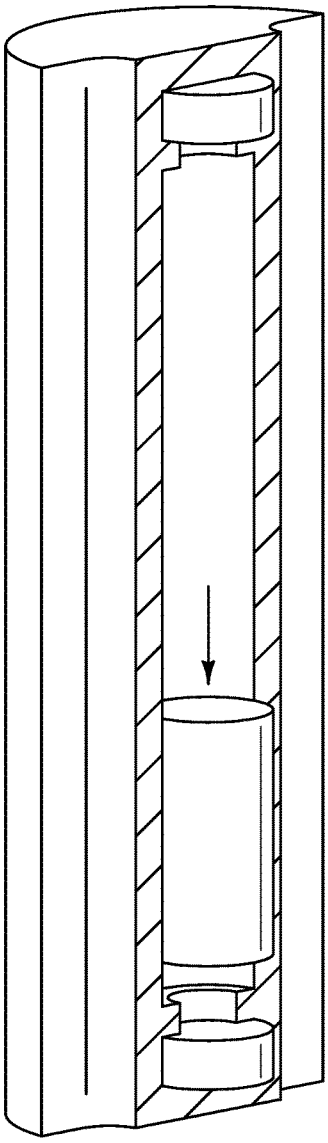
FIG. 8 is a view showing the weight at the bottom position of an embodiment of an "Internal Catapult".

FIG. 8 is a view showing the weight at the bottom or second position of the "Internal Catapult". After the bowstring has been released, the weight travels along the path of least resistance, or in this case, toward the center or midline of the bowstring. Once the heavier mass bottoms out at the distal end of the cavity, the distal small magnet disc will bias the heavier mass back to the proximal disc. The distal disc may be magnetic or any ferrous material.

Figure 9:
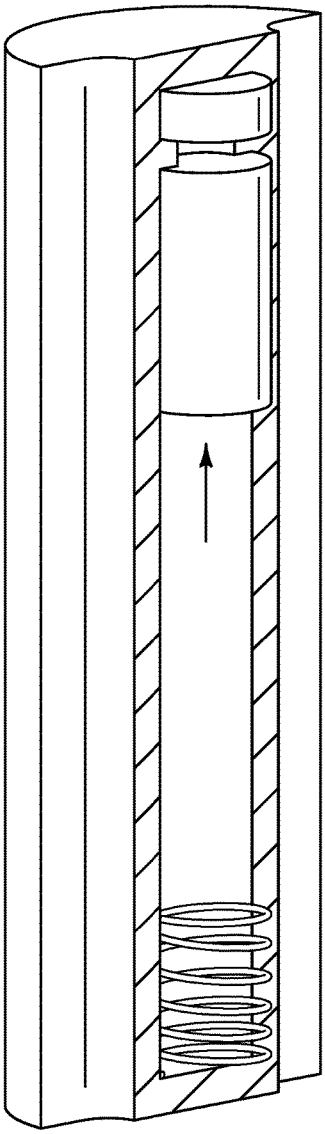
FIG. 9 is a view showing the weight at the home position and biasing spring of an embodiment of the inventive concepts disclosed herein.

FIG. 9 is a view showing the weight at the home position and biasing spring 36 to bias the weight back to the first position. A spring may take the place of a magnet or ferrous material for purposes of biasing the heavier mass slideable weight back to the home position at the proximal smaller disc. Any material that is used to bias the weight back to the home positioning may be used for this purpose.

Figure 10:
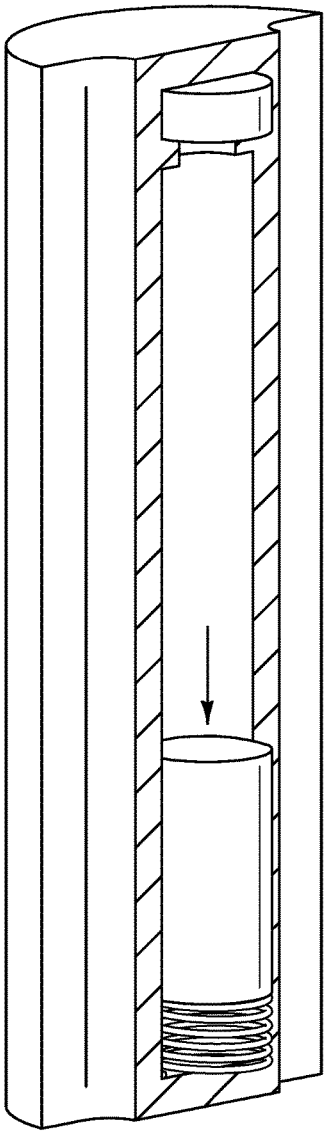
FIG. 10 is a view showing the weight at the bottom stroke prior to spring biasing the weight to the home position of an embodiment of the inventive concepts disclosed herein.

FIG. 10 is a view showing the weight at the bottom stroke position prior to spring biasing the weight to the proximal home position. The Kinetic energy of the spring will bias the heavier slideable weight back to the top portion of the cylinder or housing.

Figure 11:
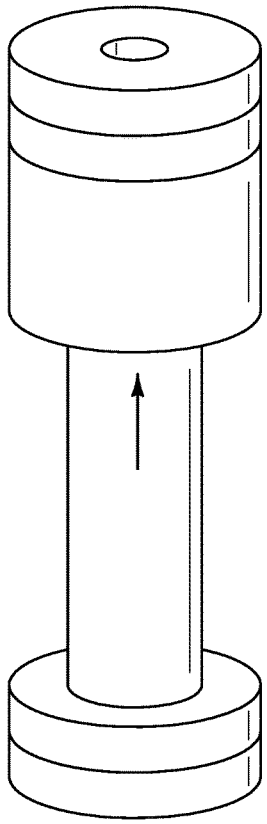
FIG. 11 shows an embodiment of an "External Catapult" which wraps around the bowstring. The weight is in the home position.

FIG. 11 shows an "External Catapult" which wraps around or circumvolves the bowstring. The weight is in the home or first position. Currently bowstring weights are placed around the bowstring. All weights placed around the bowstring are static. Bowstring weights are currently clamped or placed over the bowstring. A factory weight placement chart is given to the end user for purposes of weight placement on the string. The "External Catapult" system is designed to make a weight slideable on the outside of the bowstring. A sheath may encompass the bowstring to impede wear from the weight as it moves up and down the bowstring. FIG. 11 also shows the proximal end which consists of a shelf or stop; small magnetic disc; heavier slideable magnet or ferrous material; sheath; distal magnet; and shelf. The "External Catapult" shown in FIGS. 11, 12 is external of the bowstring.

Figure 12:
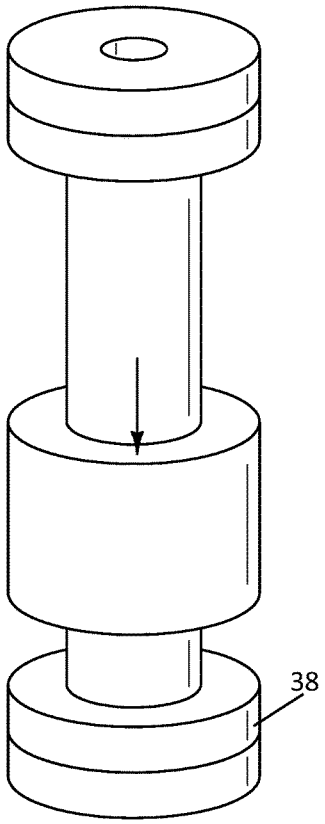
FIG. 12 shows an embodiment of an "External Catapult" with the weight sliding down the sheath.

FIG. 12 shows an "External Catapult" with the slideable weight on the sheath. After the bowstring is released, the heavier, slideable weight will follow the path of least resistance due to the inertia.

Figure 13:
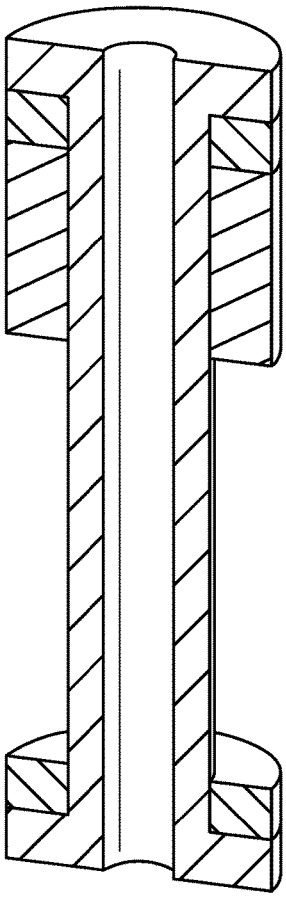
FIG. 13 show a cross sectioned view of an embodiment of an "External Catapult".

FIG. 13 shows a cross sectioned view of the "External Catapult". A center hole is seen on the External Catapult (or sheath) for purposes of accepting the bowstring. Top and Bottom shelves are placed to support the proximal and distal end discs. Between the end discs is the heavy slideable magnet. It may be noted that the proximal smaller disc may be a magnetic or made of a ferrous material. It may also be noted the middle weight or heavier weight may be magnetic or made of a ferrous material.

Figure 14:
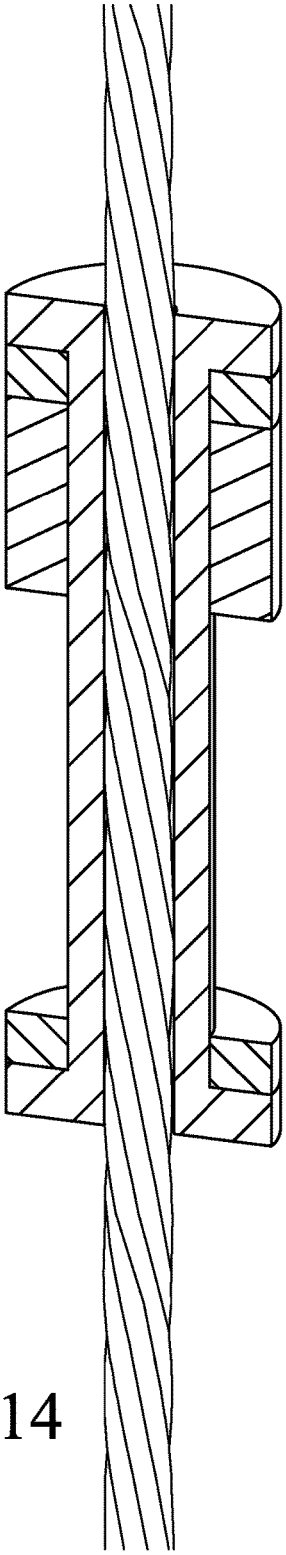
FIG. 14 shows a cross sectioned view of an embodiment of an "External Catapult" with a bowstring located in a provided groove within the "External Catapult".

FIG. 14 shows a cross sectioned view of the "External Catapult" with a bowstring located in a provided groove within the "External Catapult."

Figure 15:
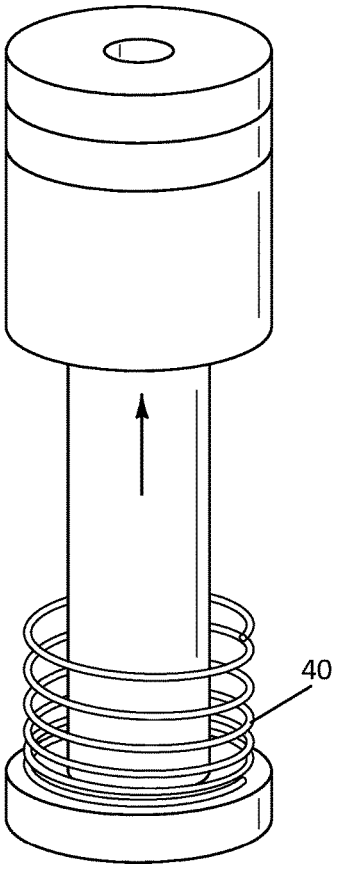
FIG. 15 shows a weight in the home position of an embodiment of the inventive concepts disclosed herein after being biased from a spring.

FIG. 15 shows a weight in the home position after being biased from a spring. This is the static home position of the heavier slideable weight. A spring rests on the distal shelf of the sheath. A taller spring may hold the heavier slideable weight to the proximal end of the upper shelf on the "External or Internal Catapult" system, and the proximal magnetic disc or ferrous disc may be excluded.

Figure 16:
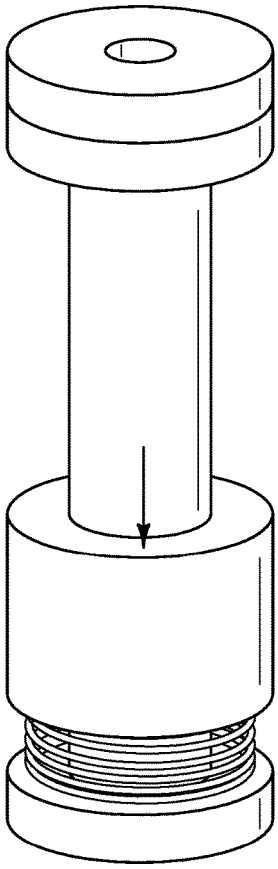
FIG. 16 shows a weight at the bottom of the stroke.

FIG. 16 shows a weight at the bottom of the stroke. The Kinetic energy of the spring will bias the heavier slideable weight back to the top portion of the cylinder or housing.

Figure 17:
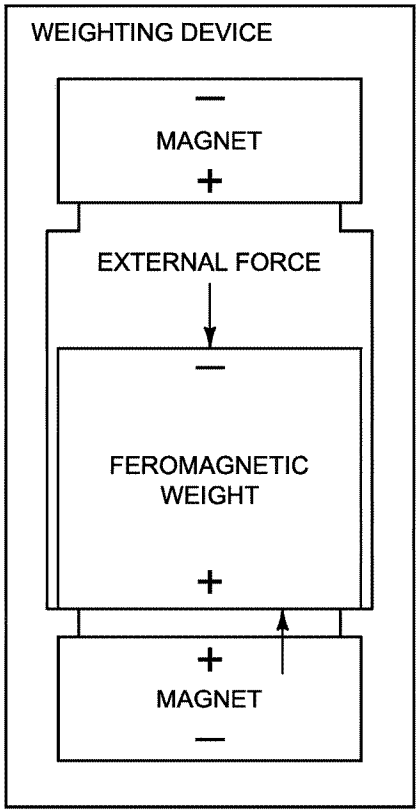
FIG. 17 shows a specific weight made of a ferromagnetic material with an external force pushing the ferromagnetic weight to the bottom of the stroke.

FIG. 17 shows a specific weight made of a ferromagnetic material with an external force pushing the ferromagnetic weight to the bottom of the stroke. FIG. 17 also depicts one magnet above the ferromagnetic material, and one magnet below the ferromagnetic material. The +positive side of the proximal disc magnet attracts the negative side of the heavier or slideable magnet. An external force such as the bowstring being released will separate the magnets. The heavier slideable magnet will travel until it reaches the bottom, at which point the distal disc magnet with a + positive force will bias the + positive side of opposing heavier slideable magnet back to the top where it will once again connect to the force of the + positive side of the heavier magnet; again resting in the home position.

Figure 18:
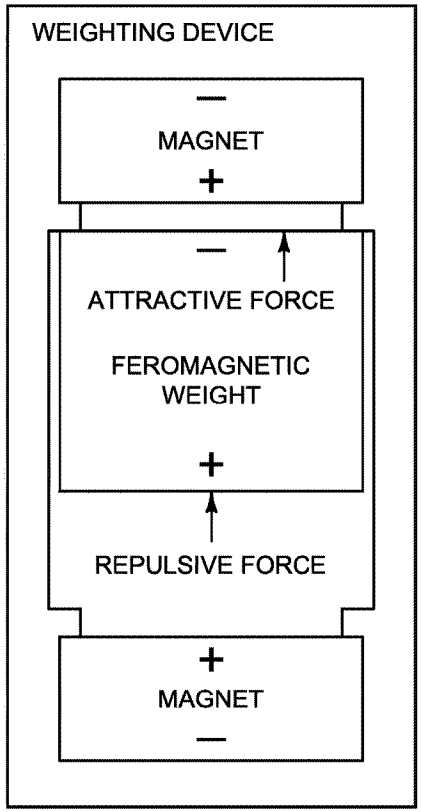
FIG. 18 shows a weight made of ferromagnetic material with a repulsive force, sending ferromagnetic weight back to the home position. One magnet is located above the ferromagnetic weight, and one magnet is below the ferromagnetic weight.

FIG. 18 shows a weight made of ferromagnetic material with a repulsive force, sending ferromagnetic slideable weight back to the home position. The proximal magnet is located above the ferromagnetic slideable weight, and one magnet is below the ferromagnetic slideable weight. FIG. 18 depicts the repulsive force between the distal disc magnet and the bottom side of the heavier magnet. The bottom of the heavier magnet may have a positive charge, as it is biased from the positive force of the smaller distal disc magnet. It may be noted that magnetic forces may have different polarity forces that accomplish the same dynamic function.

Figure 19:
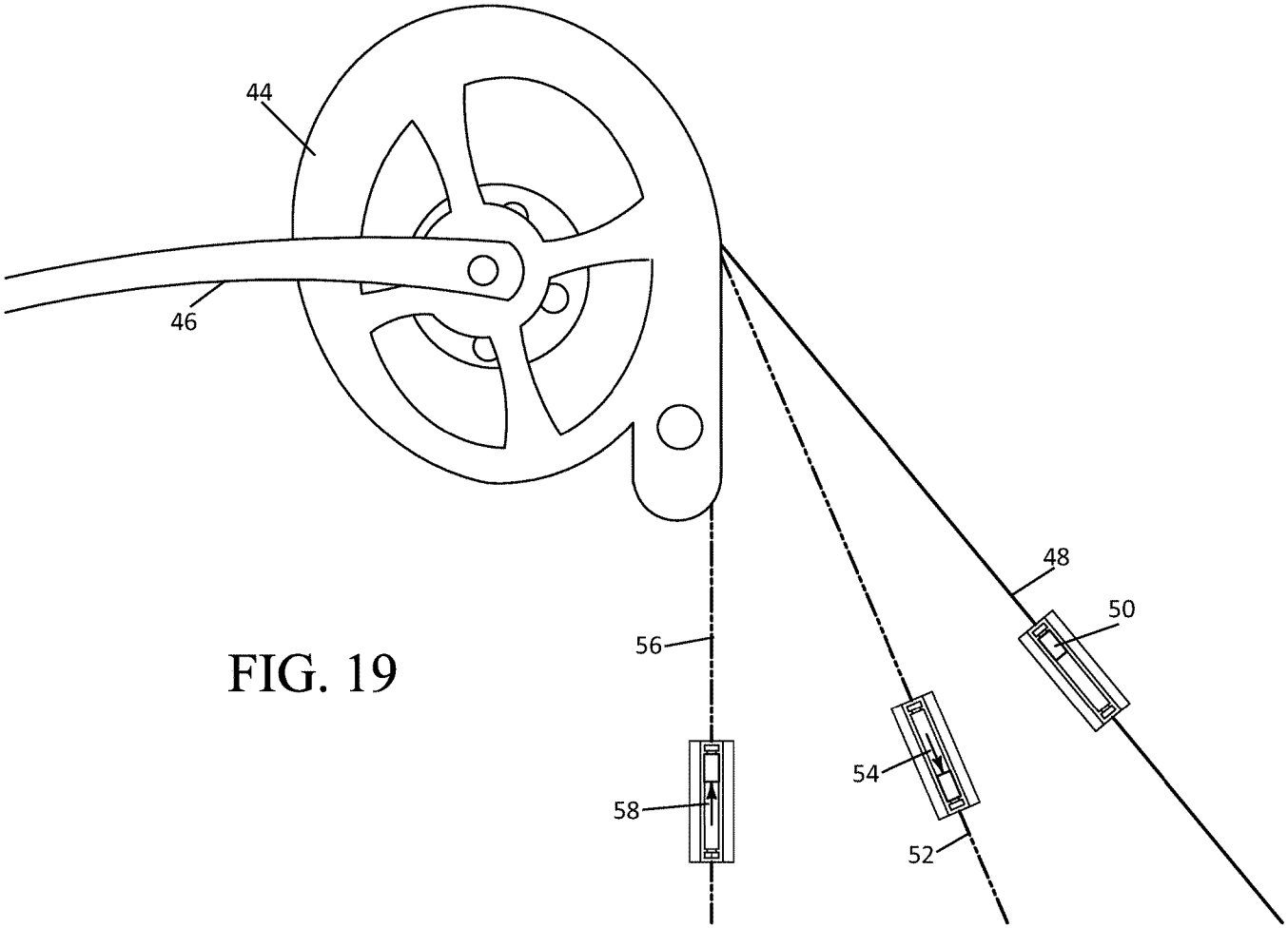
FIG. 19 shows a side view of a dynamic weight positioning on the string during the bowstring release cycle relative to a bow pulley.

FIG. 19 shows a side view of a dynamic weight positioning on the string during the bowstring release through stop cycle of a compound bow. Also depicted are a cam or pulley 44 and a bow limb 46. When the bowstring is pulled back 48, the cam will rotate clockwise, while the limb collapses. This is the stored kinetic energy that sends the arrow to the target. When the string is static, and when at full draw, the heavier slideable weight is in a resting position 50 nearest the cam side. When the string moves forward 52, toward the riser, the heavier weight will begin to transition toward the center of the bowstring as depicted by the arrow 54. Once the string has stopped its momentum 56, the heavier weight will return to the resting position near the cam side or proximal end as depicted by the arrow 58. The purpose of a slideable weight is to keep the weight close to the cam side as long as possible, and to not carry the extra weight during the bowstring release to mid cycle. Carrying the weight at a higher position on the bowstring during the transitioning bowstring cycle, the faster the bow. When the bowstring gets closer to the end of the cycle, the weight will move further from the cam, causing a catapult effect; hence, enhancing arrow speed. It will be appreciated that the invention is not limited to what has been describe herein above merely by way of example. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

I claim:

1. An archery bow comprising:

a riser;

a first limb supported by the riser;

a second limb supported by the riser;

a bowstring extending between said first limb and said second limb and defining a midline between said first limb and said second limb;

at least one freely slideable weight supported by said bowstring, said weight configured to slide from a first point located proximate said first limb toward said midline of said bowstring, wherein said weight is configured to be slideable in response to said bow being fired;

a stop positioned on said bowstring configured for stopping the sliding of said weight when said weight is sliding toward said midline of said bowstring.

2. The archery bow of claim 1, wherein said slideable weight is integrated in said bow string.

3. The archery bow of claim 1, wherein said slideable weight is attached to said bow string.

4. The archery bow of claim 1, wherein said slideable weight circumvolves said bowstring.

5. The archery bow of claim 1, wherein said archery bow comprises a compound archery bow, wherein said first limb comprises a first rotatable member and said second limb comprises a second rotatable member, wherein said bowstring extends between said first rotatable member and said second rotatable member.

6. The archery bow of claim 1, wherein said archery bow comprises a biasing mechanism configure for returning said weight from said stop toward said first limb.

7. The archery bow of claim 1, wherein said string comprises a chamber defined by a chamber housing, wherein said weight is configured to travel along said chamber.

8. The archery bow of claim 7, wherein said chamber housing comprises grooves configured for receiving strands of a split apart bowstring.

9. An archery bow comprising:

a riser;

a first limb supported by the riser;

a second limb supported by the riser;

a bowstring extending between said first limb and said second limb and defining a midline between said first limb and said second limb;

a freely slideable weight circumvolving a portion of said bowstring, wherein said weight is configured to be slideable in response to said bow being fired;

a chamber housing defining a chamber, wherein said chamber is positioned on said bowstring such that said slideable weight travels along said bowstring within said chamber between a first position and a second position.

10. The archery bow of claim 9, wherein said bow comprises a retaining mechanism for retaining said weight in a first position until a user shoots an arrow from said bow.

11. The archery bow of claim 10, wherein said retaining mechanism comprises a first magnet positioned at said first end configured to attract a second magnet, wherein said weight comprises said second magnet.

12. The archery bow of claim 11, wherein said biasing mechanism comprises a spring positioned at said second position.

13. The archery bow of claim 9, wherein said bow comprises a biasing mechanism for biasing said weight from said second position to said first position.

14. The archery bow of claim 9, wherein said chamber is positioned on said bowstring such that said first position is proximate to said first limb.

15. An archery bow comprising:

a riser;

a first limb supported by the riser;

a second limb supported by the riser;

a bowstring extending between said first limb and said second limb and defining a midline between said first limb and said second limb;

a chamber housing defining a chamber defining a length and having a first end and a second end, wherein said chamber is positioned on said bowstring such that a slideable weight is configured to travel within said chamber along said length of said chamber, wherein said chamber length is parallel to or within a plane defined by a bowstring length between said limb and said midline of said bowstring, wherein said slideable weight is configured to slide within said chamber between a first position and a second position;

wherein said slideable weight circumvolves a portion of said bowstring, wherein said weight is configured to be slideable within said chamber along said length of said chamber in response to said bow being fired.

16. The archery bow of claim 15, wherein said bow comprises a biasing mechanism for biasing said weight from said second position to said first position.

17. The archery bow of claim 16, wherein said biasing mechanism comprises a spring positioned at said second position.

18. The archery bow of claim 15, wherein said bow comprises a retaining mechanism for retaining said weight in a first position until a user shoots an arrow from said bow.

19. The archery bow of claim 18, wherein said retaining mechanism comprises a first magnet positioned proximate to said first end and configured to attract a second magnet, wherein said weight comprises said second magnet.

20. The archery bow of claim 15, wherein said chamber housing comprises grooves configured for receiving strands of a split apart bowstring.

* * * * *